US006213792B1

(12) United States Patent
Tsuji et al.

(10) Patent No.: US 6,213,792 B1
(45) **Date of Patent: *Apr. 10, 2001**

(54) CONNECTOR FITTING STRUCTURE

(75) Inventors: Masanori Tsuji; Osamu Sugiyama; Satoru Kaneko, all of Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/271,984

(22) Filed: Mar. 19, 1999

(30) Foreign Application Priority Data

Mar. 25, 1998 (JP) ..... 10-077959

(51) Int. Cl.[7] ..... H01R 13/62
(52) U.S. Cl. ..... 439/157; 439/152
(58) Field of Search ..... 439/157, 152, 439/153, 154, 155, 156, 158, 159, 160, 310, 347, 352

(56) References Cited

U.S. PATENT DOCUMENTS 5,915,982 * 6/1999 Kashiyama et al. ..... 439/157
5,919,053 * 7/1999 Tsuji et al. ..... 439/157
5,964,602 * 10/1999 Aoki et al. ..... 439/157

FOREIGN PATENT DOCUMENTS 0 722 203 A1 1/1995 (EP) .
0 736 935 A2 4/1996 (EP) .
0 825 684 A1 6/1997 (EP) .
0 940 885 A1 3/1999 (EP) .
0 940 886 A1 3/1999 (EP) .
10-21991 1/1998 (JP) .

* cited by examiner

*Primary Examiner*—Gary F. Paumen
*Assistant Examiner*—Alexander Gilman
(74) *Attorney, Agent, or Firm*—Finnegan, Henderson, Farabow, Garrett & Dunner, L.L.P.

(57) ABSTRACT

A fitting structure for connectors includes a female connector 30, a male connector 40 and a hood assembly 10. In assembling, an assembling port of the connector 30 is assembled to an opening 18 of the hood assembly 10. The engagement and disengagement between the male and female connectors 40, 30 can be accomplished by reciprocatively moving slide members 13, 13 in the hood assembly 10 while guide pins 44 are being retained in guide grooves 14 of the slide members 13, 13. Respective interior dimensions A, B, D defining the assembling port are respectively larger than respective interior dimensions a, b, d defining the opening 18 of the hood assembly 10, a step 38 is produced in a boundary area between the hood assembly 10 and the female connector 30. Without entering the female connector 30 into the hood assembly 10, it is possible to fit the male connector 40 to the female connector 30 certainly.

20 Claims, 3 Drawing Sheets

CONNECTOR FITTING STRUCTURE

BACKGROUND OF THE INVENTION

1. Field of the Invention

The present invention relates to a connector fitting structure where multipolar male and female connectors are engaged with and disengaged from each other by sliding a slide member reciprocatively.

2. Description of the Related Art

Japanese Unexamined Patent Publication (kokai) No. 8-167635 discloses the conventional connector fitting structure where male and female connectors can be engaged with each other by sliding a slide member mounted on a hood assembly.

In the disclosed structure, the hood assembly is assembled to the female connector, provided with the slide member having a guide groove formed therein. In use, when sliding the slide member, then the male connector is drawn to engage with the female connector.

The female connector for engaging a plurality of terminals therein is provided with a hood for covering respective leading ends of the terminals. While, the hood assembly is provided with a flange to be engaged with the hood. By sliding the hood assembly to one direction while engaging the flange with the hood of the female connector, some engagement holes formed in the hood assembly can be engaged with engagement projections formed on the female connector, respectively. With this engagement, the hood assembly can be assembled to the female connector. During the sliding of the hood assembly, since some press plates formed on the hood of the female connector do press restricting parts of the hood assembly, which are disposed inside the flange of the hood assembly, the hood is interposed between each restricting part and the flange, thereby causing the female connector and the hood assembly from rattling to or poorly connecting with each other.

In the above-mentioned conventional structure, however, there is a case that the hood of the female connector is positioned inside the hood assembly due to the rattling between the female connector and the hood assembly. In such a case, the leading end of the male connector being drawn into the hood assembly may butt against the hood in the hood assembly. Consequently, there is caused a problem that a manipulating force required for fitting the female and male connectors to each other is increased to cause the difficulty or impossibility of fitting.

SUMMARY OF THE INVENTION

It is therefore an object of the present invention to provide a connector fitting structure which allows the male and female connectors to be engaged with each other certainly and also easily while surely preventing the female connector and the hood assembly from rattling to each other.

The object of the present invention described above can be accomplished by a fitting structure for connectors, comprising:

a female connector;

a male connector for engagement with the female connector;

a hood assembly having an opening to be assembled to an assembling port provided on either one of the male and female connectors, the hood assembly including at least one slide member adapted so as to slide therein and provided with one or more guide grooves; and one or more guide pins formed on the other of the male and female connectors;

wherein respective interior dimensions defining the assembling port of the one of the male and female connectors are respectively larger than respective interior dimensions defining the opening of the hood assembly, thereby providing a step in a boundary area between the hood assembly and the one of the male and female connectors;

whereby the engagement and disengagement between the male and female connectors can be accomplished by reciprocatively moving the slide member while the one or more guide pins are retained in the one or more guide grooves.

In the above-mentioned structure, since the slide member does slide while the guide groove(s) of the slide member engages with the guide pin(s), the other of the male and female connectors is drawn into the one of the connectors through the hood assembly, so that both connectors can be engaged with each other.

According to the present invention, the hood assembly is assembled to one connector, for example, the female connector by assembling the opening of the hood assembly to the assembling port of the female connector. Regarding this assembling, since the interior dimensions defining the assembling port of the female connectors are respectively larger than respective interior dimensions defining the opening of the hood assembly, the step is produced in the boundary area between the hood assembly and the female connector. Thus, there is no possibility that the female connector is positioned inside the hood assembly, so that the other connector, for example, the male connector draw into the hood assembly does not butt against the female connector. Consequently, the male connector can be fitted to the female connector smooth and certainly.

In the above-mentioned fitting structure, preferably, the assembling port of the one of the male and female connectors is in the form of a frame, while the opening of the hood assembly is provided with a cover for covering the frame of the one of the male and female connectors, the cover being opened on one side thereof, so that the hood assembly can be assembled to the one of the male and female connectors by sliding the frame relatively to the hood assembly through the opened side of the cover. In this way, since the assembling of the hood assembly to one connector, for example, the female connector can be attained by the sliding movement of either one of the hood assembly and the female connector in only one direction, the assembling operation can be simplified.

In the present invention, preferably, the hood assembly comprises a hood serving as a housing of the hood assembly and a manipulating lever pivotably mounted on the hood stopper, for sliding the slide member. In this case, owing to the provision of the manipulating lever, it will be possible to simplify the sliding operation of the slide member.

In the present invention, preferably, the guide groove consists of an inlet portion opening perpendicularly to one side of the slide member, a slanted portion slanted to a direction to slide the slide member and an end portion succeeding the slanted portion in parallel with the longitudinal direction of the slide member.

With the constitution of the guide groove, the sliding movement of the slide member can be converted to a force to drawing the other connector into the hood assembly.

In the present invention, preferably, the guide groove is provided, on one side of the inlet portion, with a flexible projection for temporary engagement with the guide pin.

In this case, owing to the provision of the flexible projection, it will be possible to engage the guide pin at the inlet portion of the guide groove, for the time being.

In the present invention, preferably, the frame is shaped to be rectangular and also provided, on both sidewalls thereof, with projections, while the cover of the hood assembly is provided, on both sidewalls thereof, with engagement holes for respective engagement with the projections on the frame.

With the above structure of the frame and the cover, it is possible to engage the frame with the cover securely.

In the present invention, preferably, the assembling port is constituted by at least one male-connector fitting chamber of which length and height correspond to the interior dimensions of the assembling port, while the opening of the hood assembly is constituted by at least one male-connector accommodating chamber of which length and height correspond to the interior dimensions of the opening.

With the above constitution of the assembling port and the cover, it will be possible to produce the above step in the boundary area between the hood assembly and the female connector.

In the present invention, preferably, the hood assembly includes two slide members arranged on upper and lower sides of the hood and the manipulating lever is mounted on the hood in order to slide the slide members in opposite directions to each other.

In this case, owing to the provision of the plural slide members, it is possible to draw the other connector, for example, the male connector into the hood assembly certainly.

These and other objects and features of the present invention will become more fully apparent from the following description and appended claims taken in conjunction with the accompany drawings.

DESCRIPTION OF THE PREFERRED EMBODIMENT

Figure 1:
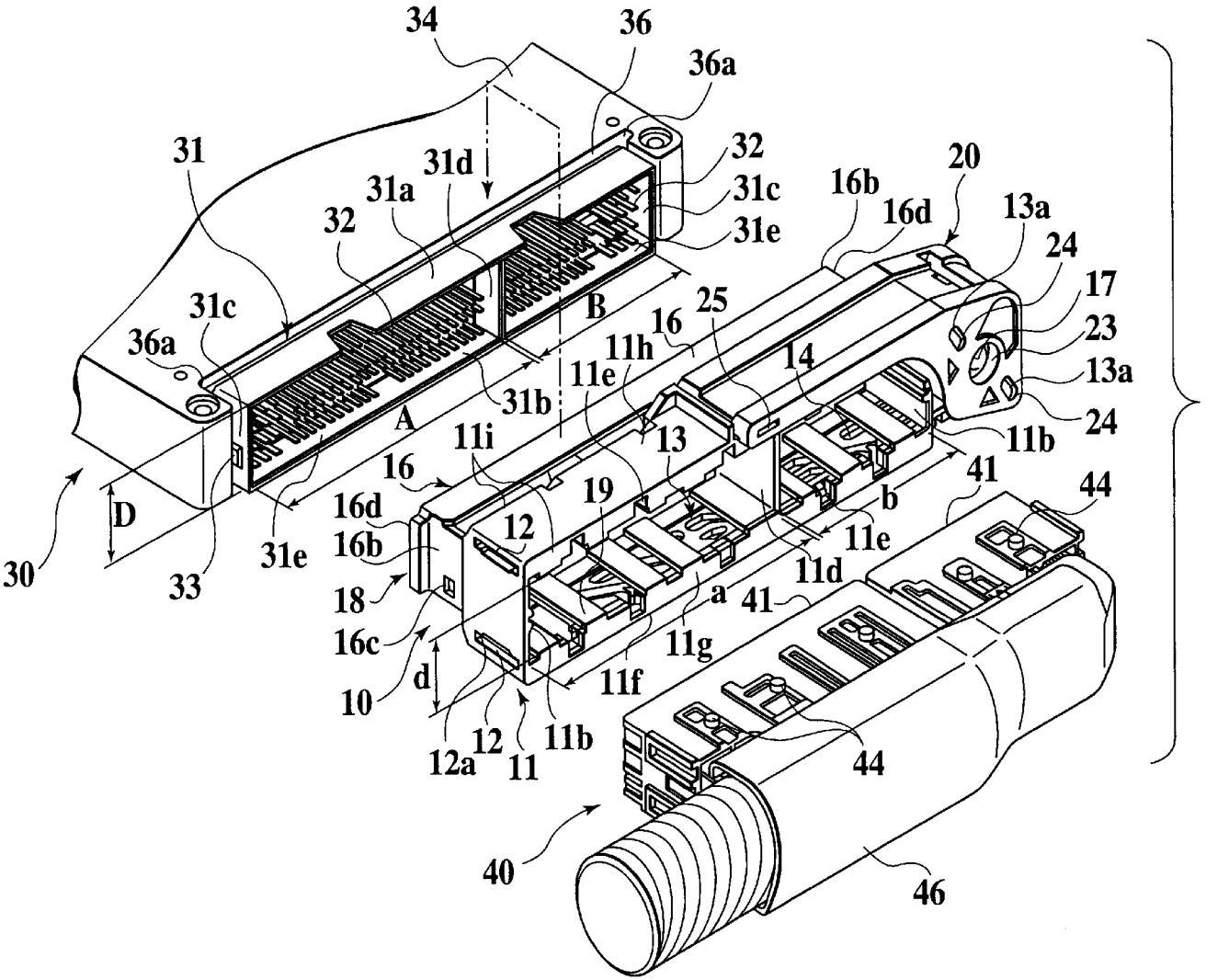
FIG. 1 is a perspective view of a connector fitting structure in accordance with an embodiment of the present invention.

Now referring to FIG. 1, the connector fitting structure of the embodiment comprises a female connector 30, a male connector 40 and a hood assembly 10, all of which are wholly made of synthetic resin. In assembly, the male connector 40 is drawn into the female connector 30 through the intermediary of the hood assembly 10.

The hood assembly 10 includes a hood 11 in the form of a rectangular cylinder, also serving as a female connector housing having a front opening 18 for fittingly fixing the female connector 30 and a rear part into which the male connector 40 is to be inserted, upper and lower slide grooves 12, 12 formed on the hood 11, a pair of slide members 13, 13 for sliding in the slide grooves 12, 12 reciprocatively and a synthetic manipulating lever 20 allowing the respective slide members 13, 13 to reciprocatively slide for engagement or disengagement of the multipolar female connector 30 with the multipolar male connector 40.

The interior of the hood 11 is divided into two "male-connector" accommodating chambers 11*b*, 11*b* through a partition wall 11*d*. Each slide groove 12 has a pair of step parts 12*a*, 12*a* formed to retain thin-walled portions of each slide member 13 on both sides thereof, respectively. Thus, the pair of slide members 13, 13 are adapted so as to reciprocatively slide into the pair of slide grooves 12, 12 in the mutual opposite directions.

The hood 11 has a bottom wall 11*f* formed to oppose a top wall 11*h*. On both sides of the bottom wall 11*f*, a pair of sidewalls 11*g*, 11*g* are formed to stand upright, integrally with the bottom wall 11*f*. Similarly, the bottom wall 11*h* has a pair of sidewalls 11*i*, 11*i* formed to stand upright on both sides of the wall 11*h*, integrally. The upper slide groove 12 is disposed between the sidewalls 11*i* and 11*i*, while the lower slide groove 12 is disposed between the sidewalls 11*g* and 11*g*. The respective ends of the opposing sidewalls 11*g*, 11*g* are connected to each other through a plurality of bridging ribs 19, . . . 19. Similarly, the respective ends of the opposing sidewalls 11*i*, 11*i* are also connected to each other through a plurality of bridging ribs 19, . . . 19. Each bridging rib 19 is arranged so as to extend perpendicularly to the sliding direction of each slide member 13. The bridging ribs 19, . . . 19 are disposed apart from each other in the longitudinal direction of the sidewalls 11*g*, 11*g*, 11*i*, 11*i*.

In this way, since both sidewalls 11*g*, 11*g*, and 11*i*, 11*i* interposing the upper and lower slide grooves 12, 12 respectively are connected to each other by the bridging ribs 19, . . . , 19, it is possible to prevent both sidewalls 11*g*, 11*g*, and 11*i*, 11*i* from curving or tumbling inward. Thus, owing to the provision of the bridging ribs 19, . . . , 19, it is possible to exclude a possibility that both sidewalls 11*g*, 11*g*, and 11*i*, 11*i* tightly come into contact with or gnaw into the slide members 13, 13 in the slide grooves 12, 12.

On the rear (the male connector's) side of the hood 11, the sidewalls 11*g*, 11*i* are respectively provided with a plurality of notch guides 11*e*, . . . , 11*e*. Each notch guide 11*e* is arranged in a position opposing to each of inlet portions 14*a* of a plurality of guide grooves 14 respectively formed in the upper and lower slide members 13, 13.

Figure 2A:
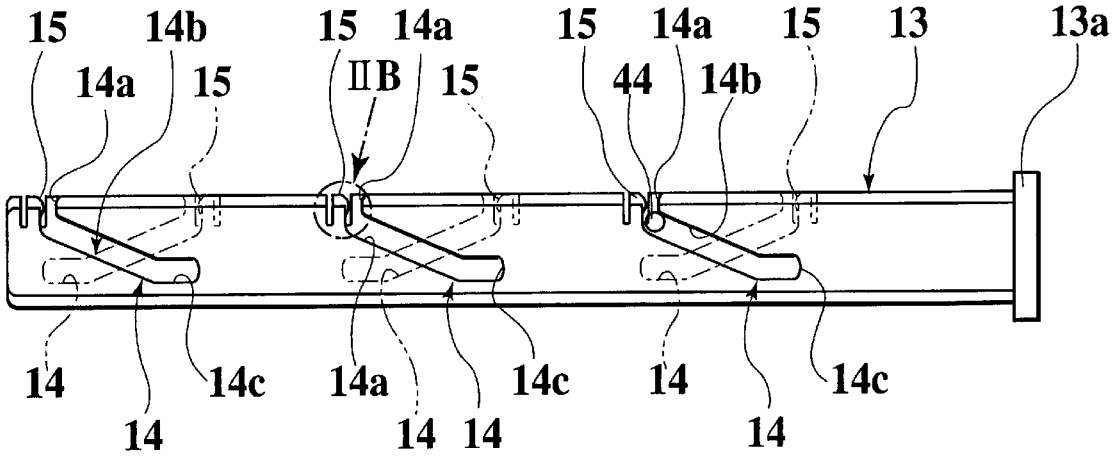
FIG. 2A is an explanatory diagram of a slide member, viewed from the side of guide grooves.

Again, each slide member 13 is provided, on a surface thereof opposing the other slide member 13, with the plural guide grooves 14 each inclining to a direction to insert each slide member 13 by a predetermined angle. As shown with solid lines and chain lines in FIG. 2A, the inclining direction of each guide groove 14 of the upper slide member 13 is opposite to the inclining direction of each guide groove 14 of the lower slide member 13. In addition, each guide groove 14 consists of the inlet portion 14*a* opening perpendicularly to one side of the slide member 13, a slanted portion 14*b* succeeding the inlet portion 14*a* and an end portion 14*c* succeeding the slanted portion 14*b* in parallel with the longitudinal direction of the slide member 13.

Figure 2B:
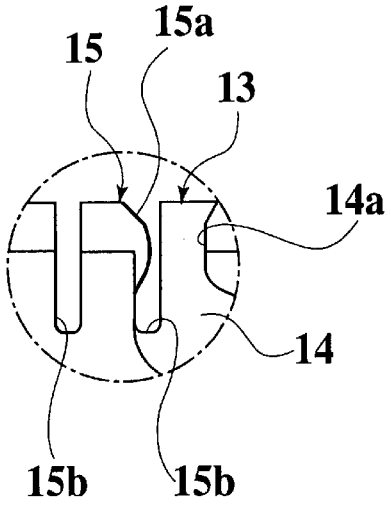
FIG. 2B is an explanatory enlarged view of a part IIB of the slide member of FIG. 2A.

On one side of each inlet portion 14*a* through which a guide pin 44 mentioned later is to be inserted into the guide groove 14, a temporary engagement means 15 is provided for temporary engagement with the guide pin 44. As shown in FIG. 2B, the temporary engagement means 15 is constituted by a flexible projection 15*a* integrally projecting so as to be in parallel with the inlet portion 14*a* and a pair of notches 15*b*, 15*b* on both sides of the flexible projection 15*a*.

The manipulating lever 20 serves to reciprocatively slide the pair of slide members 13, 13 in the opposite directions to each other and has a pivot center hole 23 formed at a center of the base part of the lever 20. Inserted into the pivot center hole 23 is a support shaft 17 which extends from the hood 11 and through which the manipulating lever 20 is carried so as to rotate up and down, by the hood 11. In the vicinity of the support shaft 17, a pair of long holes 24, 24 are respectively formed so as to put the hole 23 therebetween. The upper and lower slide members 13, 13 are respectively provided with column-shaped attachment bosses 13*a*, 13*a* which are inserted into the long holes 24, 24 in the lever 20, respectively. With the engagement of the lever 2 with the upper and lower slide members 13, 13, they can be slid in the opposite directions to each other by pivoting the manipulating lever 20 up and down.

Further, the manipulating lever 20 is provided, on one sidewall close to a leading end of the lever 20, with a rectangular engagement hole 25 for engagement with a not-shown engagement protrusion integrally formed on the sidewall 11*i* of the top wall 11*h* of the hood 11.

As mentioned before, the hood 11 is provided, on a front side thereof, with the opening 18 which is assembled to the female connector 30. The opening 18 is communicated with the male-connector accommodating chambers 11*b*, 11*b*, being the same size as the chambers 11*b*, 11*b*. About the opening 18, an elongated U-shaped cover 16 is provided to have an upper face 16*a* and right and left side faces 16*b*, 16*b*, opening downward.

On both side faces 16*b*, 16*b* of the cover 16, engagement holes 16*c* are formed for respective engagement with projections 33 of the female connector 30. Additionally, the cover 16 is provided, on both side faces 16*b*, 16*b*, with respective guide ribs 16*d*, 16*d* which operate to guide the hood assembly 10 when assembling it to the female connector 30. Note, the assembling of the hood assembly 10 to the female connector 30 can be accomplished by inserting a frame part 31 of the connector 30 through the above-mentioned opening underside of the cover 16 as shown with arrow of FIG. 1.

In the female connector 30, the frame part 31 engages with and carries a large number of pin-terminals 32 soldered to a printed wiring baseplate (not shown). The frame part 31 operates as an assembling entrance to which the cover 16 of the hood 11 is assembled. The frame part 31 is shaped in the form of a rectangular frame consisting of top and bottom walls 31*a*, 31*b* and both of left and right sidewalls 31*c*, 31*c*.

Owing to the provision of a partition wall 31*d* opposing the partition wall 11*d* of the hood 11, the interior of the frame 31 is divided into a pair of "male-connector" fitting chambers 31*e*, 31*e* for respective engagement with two connector housings 41, 41 of the male connector 40. Furthermore, on respective exterior faces of the left and right sidewalls 31*c*, 31*c* of the frame 31, the above-mentioned projections 33, 33 are formed to engage in the engagement holes 16*c*, 16*c* of the hood 11, respectively.

The frame 31 is arranged on the rear side of a casing 34 fixed on the printed wiring baseplate through fixings (not shown). Defined between the rear side of the casing 34 and the frame 31 is a clearance 36 which is longer than the frame 31. Both ends of the clearance 36 in the longitudinal direction constitute guide recesses 36*a*, 36*a* for guiding the guide ribs 16*d*, 16*d* of the hood 11, respectively.

As to the dimensions of the frame 31 (i.e. an assembling port) of the female connector 30 and the opening 18 (i.e. the male-connector accommodating chamber 11*b*) of the hood 11, respective dimensions of the interior of the frame 31 are established larger than respective dimensions of the interior of the opening 18, respectively. In detail, providing that the length of the "male-connector" fitting chambers 31*e*, 31*e* of the frame 31 are respectively represented by the alphabets A, B and the height of each chamber 31*e* is represented by the alphabet D, while the length of the "male-connector" accommodating chambers 11*b*, 11*b* of the opening 18 are respectively represented by the alphabets a, b and the height of each chamber 11*b* is represented by the alphabet d, there are established the following relationships of:

A>a, B>b and D>d

Figure 3:
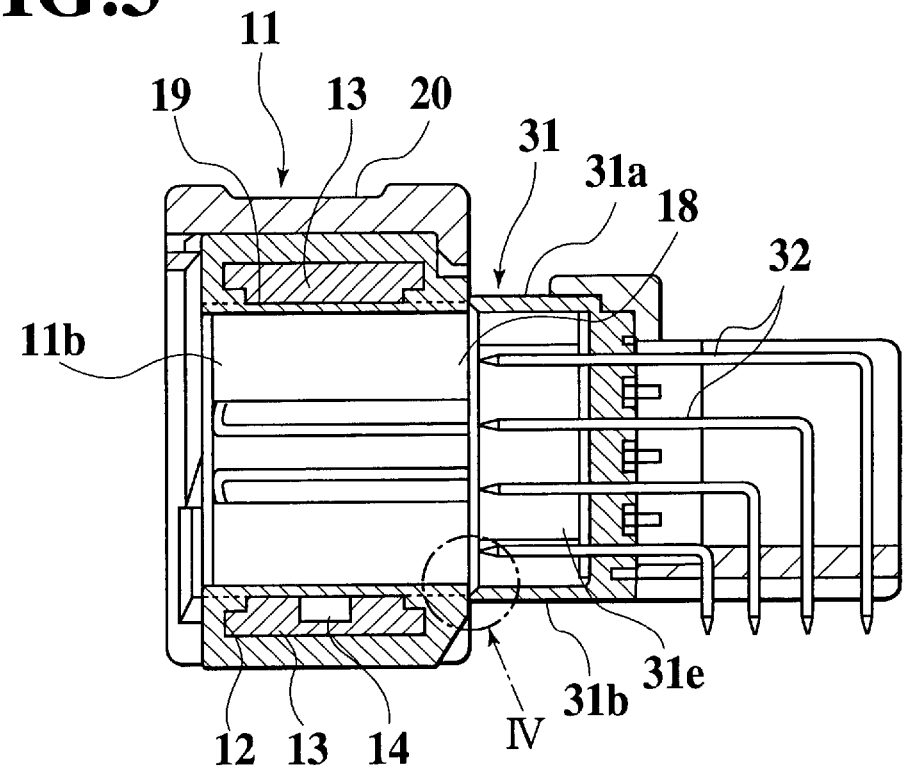
FIG. 3 is a cross sectional view showing a condition that a hood assembly is assembled to a female connector.
Figure 4:
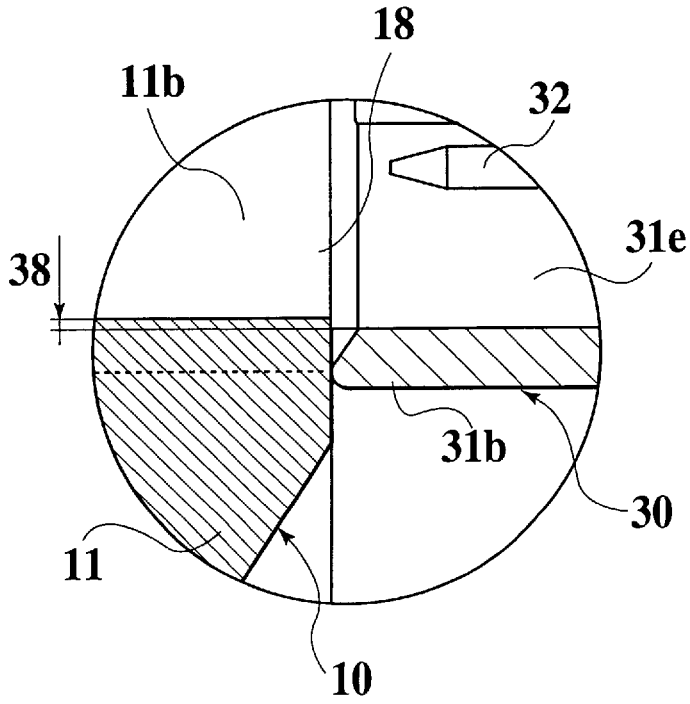
FIG. 4 is an explanatory enlarged view of a part IV of FIG. 3.

With the above dimensional relationships of the interiors, when the hood assembly 10 is assembled to the female connector 30, as shown in FIGS. 3 and 4, it is possible to produce a step 38 in a boundary area between the opening 18 and the frame 31, corresponding to a difference in dimension (height) therebetween.

Again, the male connector 40 is provided with the pair of connector housings 41, 41 which are respectively inserted into the male-connector accommodating chambers 11*b*, 11*b* separated from each other by the partition wall 11*d* of the hood 11. These connector housings 41, 41 are to be inserted into the hood 11 from a direction perpendicular to the movement direction of the slide members 13, 13. Note, engaged and carried in the interior of each connector housing 41 are a plurality of terminals (not shown) into which the pin-terminals 32 of the female connector 30 are to be inserted in order to attain the electrical connection between the female connector 30 and the male connector 40.

On both upper and lower faces of the connector housing 41, the plural guide pins 44 are formed to respectively match the notch guides 11*e* and movably engage in the guide grooves 14 of the slide members 13. Note, a plurality of wires are connected to the terminals in the connector housing 41 and withdrawn out of the housing 41 in the form of a bundle since they are covered with a cover 46.

According to the shown embodiment, as shown with the arrow with no reference numeral or alphabet of FIG. 1, the hood assembly 10 can be assembled to the female connector 30 by overlaying the front cover 16 of the hood assembly 10 on the rear frame 31 of the female connector 30 from its upside. Then, with the movement of the guide ribs 16*d*, 16*d* on both sides of the cover 16 16*d* of the hood assembly 10, the hood assembly 10 can be lowered without producing any positional deviation between the rear frame 31 and the cover 16 in plan view. With the hood's lowering, the projections 33 of the frame 31 engage in the engagement holes 16*c* of the cover 16, so that the opening 18 of the hood assembly 10 is assembled and fixed to the assembling port of the female connector 30, that is, the frame 31.

In the so-assembled condition, since the interior dimensions of the frame 31 of the female connector 30 are larger than the interior dimensions of the cover 16 of the hood assembly 10, the step 38 is formed at the boundary between the walls 31*a*, 31*b* and the sidewalls 31*c*, 31*c* of the female connector 30 and the opening 18 of the hood assembly 10, so that the respective walls 31*a*, 31*b*, 31*c*, 31*c* come into contact with the end face of the hood 11. Thus, there is no possibility that the walls 31*a*, 31*b*, 31*c*, 31*c* enter into the opening 18 of the hood assembly 10.

Consequently, since the male connector 40 drawn into the male-connector accommodating chamber 11*b* of the hood assembly 10 does not butt against the walls 31*a*, 31*b*, 31*c*, 31*c* of the female connector 30, there can be eliminated a possibility of increasing the manipulation force required in fitting the male connector 40 to the female connector 30, while the male connector 40 can be fitted to the female connector 30 certainly. In addition, even if the hood 11 is curved inwardly, the step 38 could absorb such an inward curve, thereby allowing the male connector 40 to be withdrawn into the hood 11.

After assembling the female connector 30 to the hood assembly 10, the male connector 40 is inserted into the hood 11 from the opposite side to the female connector 30, so that the guide pins 44 of the male connector 40 enter into the inlet portions 14*a* of the guide grooves 14 of the slide members 13, 13 through the notch guides 11*e* of the hood 11. Under this condition, when rotating the manipulating lever 20 to the downside, the slide members 13, 13 are slid in the upper and lower slide grooves 12, 12 of the hood 11 in the reciprocating direction. With the movements of the slide members 13, each guide pin 44 moves from the inlet portion 14*a* to the end portion 14*c* through the slanted portion 14*b*, so that the male connector 40 is drawn into the hood 11 for the mutual engagement of the connectors 30, 40.

The engagement between the multipolar female connector 30 and the multipolar male connector 40 can be certainly locked since the projection on the hood 11 is engaged in the engagement hole 25 in the sidewall 22 of the manipulating lever 20 at the time of the completion of rotating the manipulating lever 20 downward.

On the contrary, when rotating the manipulating lever 20 upward, the respective slide members 13, 13 slide in the upper and lower slide grooves 12 in the hood 11 in the mutual reciprocating directions. With the slide movements of the slide members 13, 13, each guide pin 44 moves from the end portion 14*c* to the inlet portion 14*a* through the slanted portion 14*b*, so that the male connector 40 is separated from the hood 11 for the disengagement of the connectors 30, 40.

In the above-mentioned ways, the engagement and disengagement between the female connector 30 and the female connector 40 can be accomplished.

Finally, it will be understood by those skilled in the art that the foregoing description is related to one preferred embodiment of the disclosed fitting structure for connectors, and that various changes and modifications may be made to the present invention without departing from the spirit and scope thereof.

For example, in one modification of the embodiment, the male connector 40 may have the above-mentioned frame 31, while the hood assembly 10 has the opening 18 to be assembled to the frame 31. In such a case, one or more guide pins would be provided on the female connector 30.

Additonally, two slide mambers 13, 13 of the hood assembly 10 may be replaced with a single slide member in the modification. Similarly, the slide member 13 may be provided with a single guide groove corresponding to a single guide pin formed on the male connector 40.

What is claimed is:

1. A fitting structure for connectors, comprising:

a female connector having at least two projections and at least two guide recesses;

a male connector for engagement with the female connector;

a hood assembly having an opening to be assembled to an assembling port provided on either one of the male and female connectors, the hood assembly including at least one slide member adapted so as to slide therein and provided with one or more guide grooves, the hood assembly further including at least two engagement holes for respective engagement with the at least two projections and at least two guide ribs to guide the hood assembly when interengaging with the female connector; and one or more guide pins formed on the other connector of the male and female connectors;

wherein respective interior dimensions defining the assembling port of the one of the male and female connectors are respectively larger than respective interior dimensions defining the opening of the hood assembly, thereby providing a step in a boundary area between the hood assembly and the one of the male and female connectors;

whereby the engagement and disengagement between the male and female connectors can be accomplished by reciprocatively moving the slide member while the one or more guide pins are retained in the one or more guide grooves;

whereby the hood assembly is connected to the female connector by overlaying the hood assembly in a direction perpendicular to a mating direction onto the female connector and then lowering the hood assembly so that the guide ribs engage with the guide recesses and the projections engage with the engagement holes.

2. A fitting structure as claimed in claim 1, wherein the assembling port of the one of the male and female connectors is in the form of a frame, while the opening of the hood assembly is provided with a cover for covering the frame of the one of the male and female connectors, the cover being opened on one side thereof, whereby the hood assembly can be assembled to the one of the male and female connectors by sliding the frame relatively to the hood assembly through the opened side of the cover.

3. A fitting structure as claimed in claim 2, wherein the hood assembly comprises a hood serving as a housing of the hood assembly and a manipulating lever pivotably mounted on the hood, for sliding the slide member.

4. A fitting structure as claimed in claim 3, wherein the guide groove comprises an inlet portion opening perpendicularly to one side of the slide member, a slanted portion slanted to a direction to slide the slide member and an end portion succeeding the slanted portion, in parallel with the longitudinal direction of the slide member.

5. A fitting structure as claimed in claim 4, wherein the guide groove is provided, on one side of the inlet portion, with a flexible projection for temporary engagement with the guide pin.

6. A fitting structure as claimed in claim 5, wherein the frame is shaped to be rectangular and also provided, on both sidewalls thereof, with projections, while the cover of the hood assembly is provided, on both sidewalls thereof, with engagement holes for respective engagement with the projections on the frame.

7. A fitting structure as claimed in claim 6, wherein the assembling port is constituted by at least one male-connector fitting chamber of which length and height correspond to the interior dimensions of the assembling port, while the opening of the hood assembly is constituted by at least one male-connector accommodating chamber of which length and height correspond to the interior dimensions of the opening.

8. A fitting structure as claimed in claim 7, wherein the hood assembly includes two slide members arranged on upper and lower sides of the hood and the manipulating lever is mounted on the hood in order to slide the slide members in opposite directions to each other.

9. A connector fitting structure, comprising:

a first connector having an assembling port with an interior dimension, and at least two projections and at least two guide recesses;

a second connector having an assembling port with an interior dimension; and a hood assembly having an opening capable of interengaging with the assembling port of the first connector and with the assembling port of the second connector, the opening having an interior dimension that is respectively larger than an interior dimension of the assembling port of either the first connector or the second connector, the hood assembly further including at least two engagement holes for respective engagement with the at least two projections and at least two guide ribs to guide the hood assembly when interengaging with the first connector, whereby a step in a boundary area is formed between the hood assembly and the first connector when the hood assembly is interengaged with the first connector, and a step in a boundary is formed between the hood assembly and the second connector when the hood assembly is interengaged with the second connector, whereby the hood assembly is connected to the first connector by overlaying the hood assembly in a direction perpendicular to a mating direction onto the first connector and then lowering the hood assembly so that the guide ribs engage with the guide recesses and the projections engage with the engagement holes.

10. A fitting structure as claimed in claim 9, wherein the opening of the hood assembly is interengaged with the assembling port of the first connector.

11. A fitting structure as claimed in claim 9, wherein the opening of the hood assembly is interengaged with the assembling port of the second connector.

12. A fitting structure as claimed in claim 9, wherein the opening of the hood assembly is interengaged with the assembling port of the first connector and the opening of the hood assembly is interengaged with the assembling port of the second connector.

13. A fitting structure as claimed in claim 9, wherein the hood assembly further comprises at least one slide member adapted to slide within the hood assembly and having at least one guide groove formed thereon.

14. A fitting structure as claimed in claim 13, wherein the second connector has at least one guide pin formed thereon such that engagement and disengagement between the first and second connectors can be accomplished by reciprocally moving the at least one slide member while the at least one guide pin is retained in the at least one guide groove.

15. A connector fitting structure, comprising:

a first connector having an assembling port with an interior dimension;

a second connector having an assembling port with an interior dimension and a guide pin formed thereon, and at least two projections and at least two guide recesses; and;

a hood assembly having an opening capable of interengaging with the assembling port of the first connector and with the assembling port of the second connector, the opening having an interior dimension that is respectively larger than an interior dimension of the assembling port of either the first connector or the second connector, the hood assembly also having a slide member with a guide groove to slide within the hood assembly, the hood assembly further including at least two engagement holes for respective engagement with the at least two projections and at least two guide ribs to guide the hood assembly when interengaging with the second connector, whereby a step in a boundary area is formed between the hood assembly and the first connector when the hood assembly is interengaged with the first connector, and a step in a boundary is formed between the hood assembly and the second connector when the hood assembly is interengaged with the second connector, whereby engagement and disengagement between the first and second connectors can be accomplished by reciprocally moving the slide member while the guide pin is retained in the guide groove, whereby the hood assembly in a direction perpendicular to a mating direction is connected to the female connector by overlaying the hood assembly onto the second connector and then lowering the hood assembly so that the guide ribs engage with the guide recesses and the projections engage with the engagement holes.

16. A fitting structure as claimed in claim 15, wherein the hood assembly has a plurality of slide member and a plurality of guide grooves, and the second connector has a plurality of guide pins.

17. A fitting structure as claimed in claim 15, wherein the opening of the hood assembly is interengaged with the assembling port of the first connector and the opening of the hood assembly is interengaged with the assembling port of the second connector.

18. A fitting structure as claimed in claim 15, wherein the assembling port of at least one of the connectors is in the form of a frame, and the opening of the hood assembly is provided with a cover for covering the frame of at least one of the connectors, the cover being opened on one side thereof, whereby the hood assembly can be assembled to the one of the connectors by sliding the frame relatively to the hood assembly through the opened side of the cover.

19. A fitting structure as claimed in claim 18, wherein the hood assembly comprises a hood serving as a housing of the hood assembly and a manipulating lever pivotably mounted on the hood for sliding the slide member, and the guide groove comprises an inlet portion opening perpendicularly to one side of the slide member, and a slanted portion is slanted to a direction to slide the slide member and an end portion succeeding the slanted portion in parallel with the longitudinal direction of the slide member, and the guide groove is provided on one side of the inlet portion with a flexible projection for temporary engagement with the guide pin.

20. A fitting structure as claimed in claim 19, wherein the frame is shaped to be rectangular and also provided on both sidewalls thereof with projections, and the cover of the hood assembly is provided on both sidewalls thereof with engagement holes for respective engagement with the projections on the frame, and at least one of the assembling ports is constituted by at least one connector fitting chamber of which length and height correspond to the interior dimensions of at least one assembling port, and the opening of the hood assembly is constituted by at least one connector accommodating chamber of which length and height correspond to the interior dimensions of the opening, and wherein the hood assembly includes two slide members arranged on upper and lower sides of the hood and the manipulating lever is mounted on the hood in order to slide the slide members in opposite directions to each other.

* * * * *